US006146112A

United States Patent [19]

Chou

[11] Patent Number: 6,146,112

[45] Date of Patent: Nov. 14, 2000

[54] AIR COMPRESSOR HAVING SIMPLIFIED STRUCTURE

[76] Inventor: Wen San Chou, No. 15, Lane 833, Wen Hsien Road, Tainan, 704, Taiwan

[21] Appl. No.: 09/460,194

[22] Filed: Dec. 11, 1999

[30] Foreign Application Priority Data

Apr. 2, 1999 [TW] Taiwan ..... 088201898

[51] Int. Cl.[7] ..... F04B 17/03

[52] U.S. Cl. ..... 417/360; 417/415

[58] Field of Search ..... 417/360, 415, 417/319

[56] References Cited

U.S. PATENT DOCUMENTS 4,539,941 9/1985 Wang ..... 123/18 R 4,551,074 11/1985 Asaka et al. ..... 417/366

5,215,447 6/1993 Wen ..... 417/415

5,655,887 8/1997 Chou ..... 417/63

5,988,994 11/1999 Berchowitz ..... 417/415

*Primary Examiner*—Charles G. Freay

*Assistant Examiner*—Robert Z. Evora

[57] ABSTRACT

An air compressor includes a piston slidably received in a housing. A tube and a pipe are extended from the housing for coupling to a pressure gage and a nozzle. A passage is formed between the housing and the tube. A check valve is received in the tube. A piston is slidably received in the housing. A base is secured to the housing for supporting a motor. A gear and a weight are rotatably secured to the base. The weight has an eccentric pin coupled to the piston. The motor is coupled to the gear for moving the piston up and down along the housing in a reciprocating action.

1 Claim, 4 Drawing Sheets

AIR COMPRESSOR HAVING SIMPLIFIED STRUCTURE

BACKGROUND OF THE INVENTION

1. Field of the Invention

The present invention relates to an air compressor, and more particularly to an air compressor having a simplified structure.

2. Description of the Prior Art

Typical air compressors comprise a piston having a large amount of elements and members required to be manufactured and assembled together, such that the cost for the air compressors is greatly increased.

The present invention has arisen to mitigate and/or obviate the afore-described disadvantages of the conventional air compressors.

SUMMARY OF THE INVENTION

The primary objective of the present invention is to provide an air compressor including a simplified structure for allowing the air compressor to be easily manufactured and assembled.

In accordance with one aspect of the invention, there is provided an air compressor comprising a housing including a tube and a pipe extended from the tube and including a passage communicating the housing with the tube, the housing including a chamber and at least one extension, a pressure gage and a nozzle connected to the pipe, a check valve including a valve member slidably received in the tube, and means for biasing the valve member to block the passage of the housing and to prevent air from flowing from the tube to the housing, a piston slidably received in the housing and including a rod, a base including at least one sleeve provided thereon for receiving the extension of the housing, means for securing the base to the housing, and means for forcing the piston to move along the chamber of the housing in a reciprocating action, the forcing means including a motor secured to the base and having a pinion provided thereon, a weight including a pivot shaft extended outward therefrom and rotatably secured to the casing at the pivot shaft, the weight including a pin extended therefrom and eccentric relative to the pivot shaft, the pin being rotatable coupled to the rod, the weight including at least one shoulder formed therein, a gear rotatably secured to the base at the pivot shaft and engaged with the pinion and driven by the motor via the pinion, the gear including at least one ear extended therefrom and engaged with the shoulder of the weight for connecting the gear to the weight and for allowing the weight and the gear to be rotated in concert with each other. The motor and the gear and the weight are allowed to be attached onto the base before the base is secured to the housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
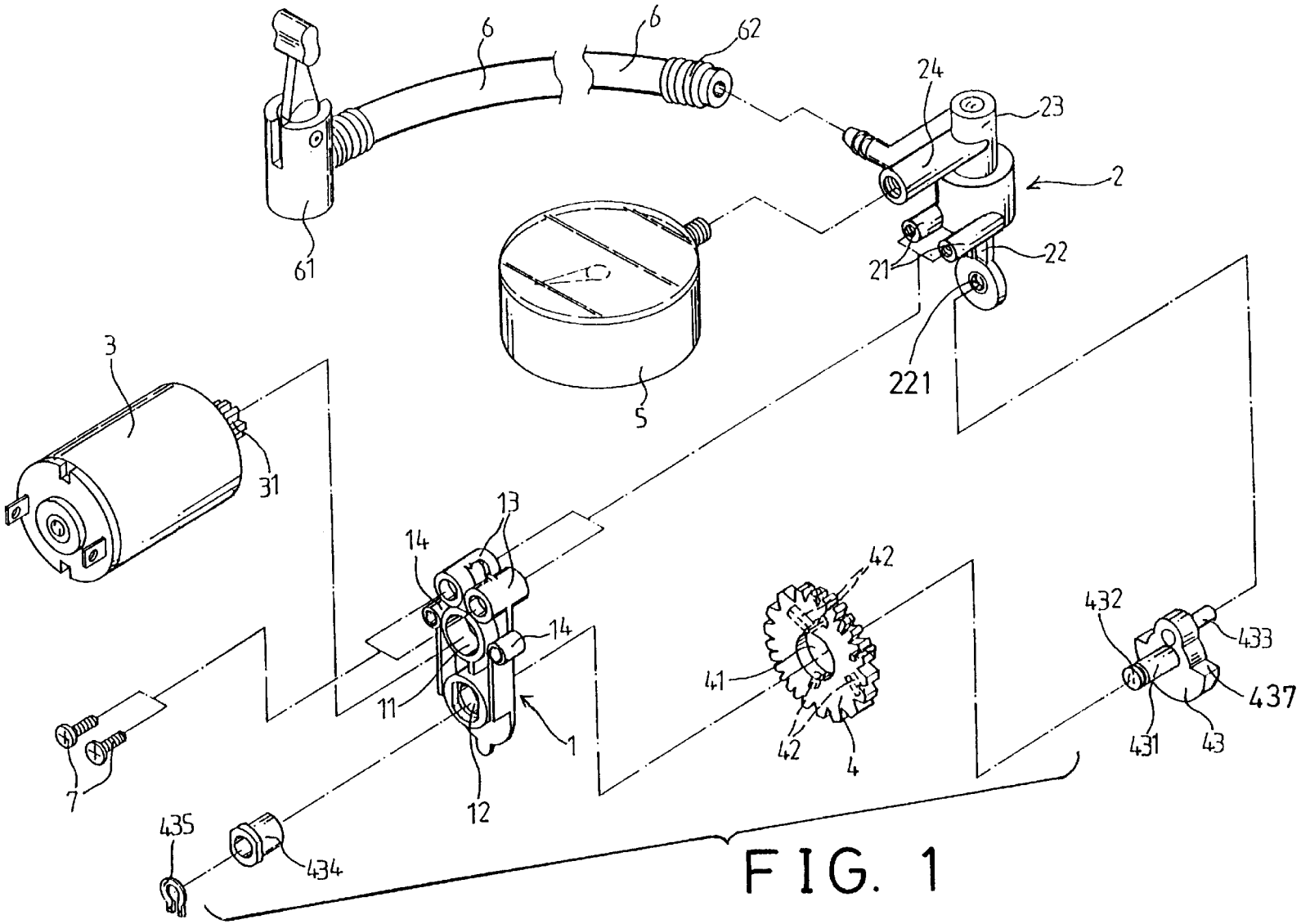
FIG. 1 is an exploded view of an air compressor in accordance with the present invention.
Figure 2:
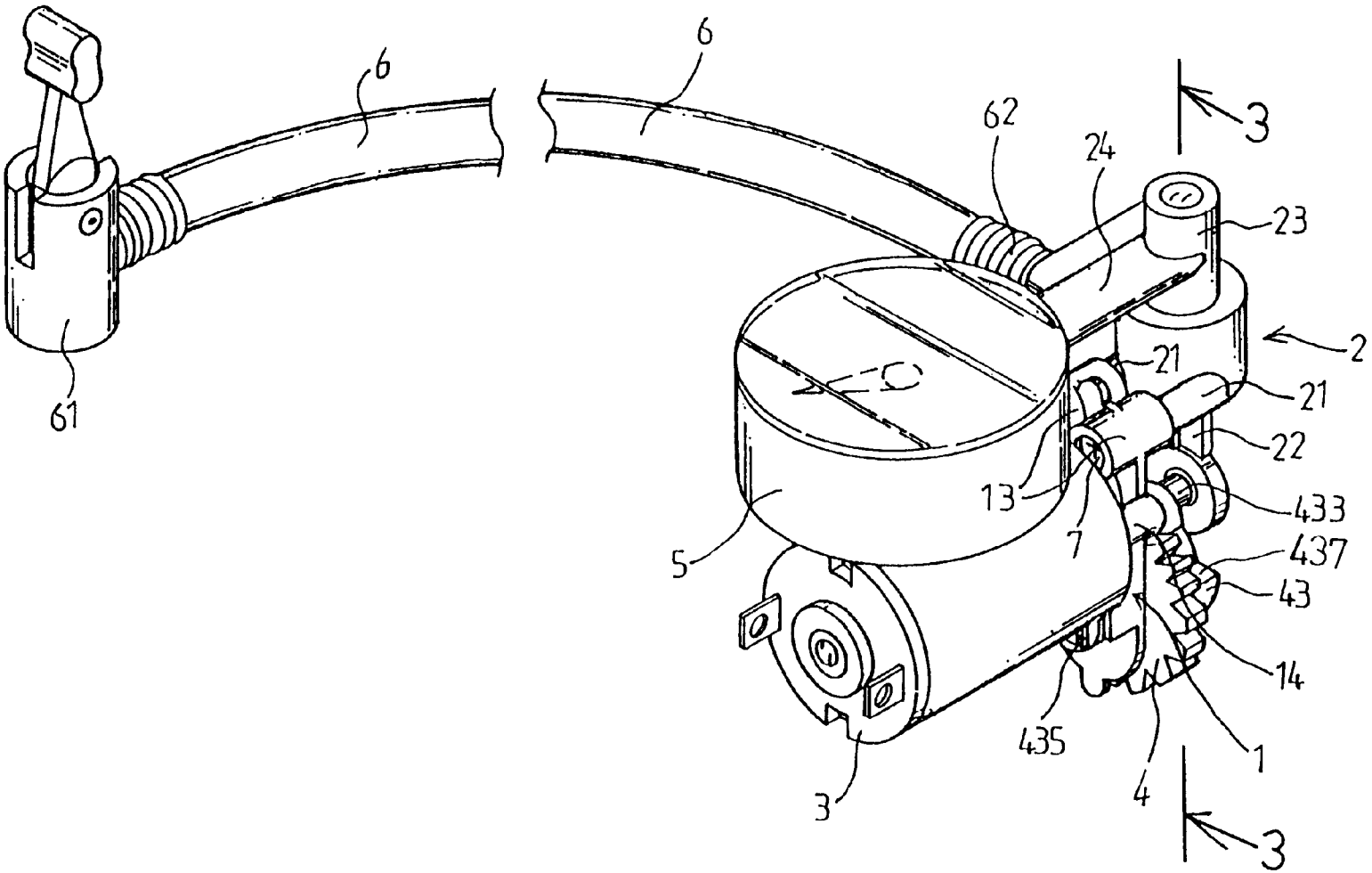
FIG. 2 is a perspective view of the compressor.
Figure 3:
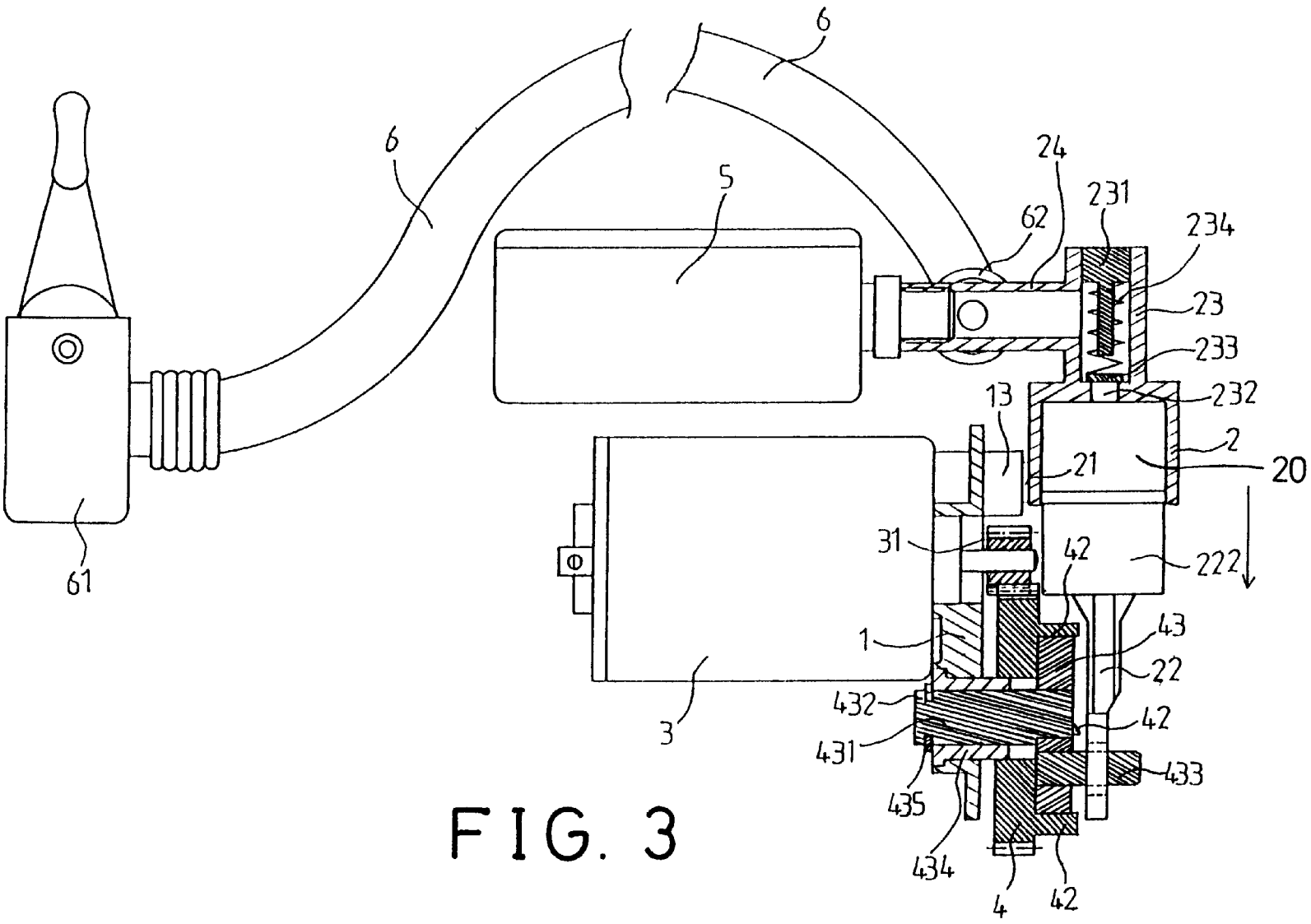
FIG. 3 is a partial cross sectional view taken along lines 3—3 of FIG. 2.

Referring to the drawings, and initially to FIGS. 1–3, an air compressor in accordance with the present invention comprises a base 1 including an opening 11 formed therein for receiving a pinion 31 of a motor 3 which is secured to the base 1 by such as the fasteners that are engaged through the holes 14 of the base 1 and are threaded to the screw holes of the motor 3 for securing the motor 3 to the base 1. The base 1 includes an aperture 12 formed therein. A weight 43 includes a pivot shaft 431 extended outward therefrom and engaged through the aperture 12 of the base 1 and rotatably secured to the base 1 with a clamping ring 435 which is engaged with an annular groove 432 of the pivot shaft 431. A bushing 434 is engaged in the aperture 12 of the base 1 and is engaged between the pivot shaft 431 and the base 1 for rotatably securing and supporting the pivot shaft 431 to the base 1. A gear 4 includes a hole 41 formed therein for receiving the pivot shaft 431 and for rotatably securing to the base 1 at the pivot shaft 431 and includes one or more ears 42 extended therefrom for engaging with one or more shoulders 437 of the weight 43 and for rotating the weight 43 such that the weight 43 and the gear 4 rotate in concert with each other. The weight 43 includes a pin 433 spaced from the pivot shaft 431 or eccentric relative to the pivot shaft 431 and extended away from the pivot shaft 431. The gear 4 is engaged with the pinion 31 of the motor 3 and may thus be driven by the motor 3. The base I includes a pair of sleeves 13 provided on top thereof.

A housing 2 is secured to the base 1 and includes a tube 23 extended upward therefrom, and a pipe 24 extended from the tube 23. The housing 2 is coupled to a nozzle 61 and/or a hose 6 via a coupler 62 for output the pressurized air generated by the compressor. An air gage or a pressure gage 5 is coupled to the pipe 24 for measuring the air pressure in the housing 2. The housing 2 includes a chamber 20 (FIG. 3) formed therein for slidably receiving a piston 222, and includes a passage 232 formed therein (FIGS. 3, 4) for communicating the chamber 20 of the housing 2 with the tube 23. The piston 222 includes a rod 22 extended downward therefrom and having an orifice 221 formed in the bottom portion thereof for rotatably receiving and securing the pin 433 of the weight 43 by such as a bearing device. such that the piston 222 may be moved up and down along the chamber 20 of the housing 2 in a reciprocating action by the motor 3 via the eccentric pin 433 of the weight 43. The housing 2 includes two extensions 21 extended therefrom and engaged through the sleeves 13 of the base 1 and secured to the base 1 with fasteners 7.

Figure 4:
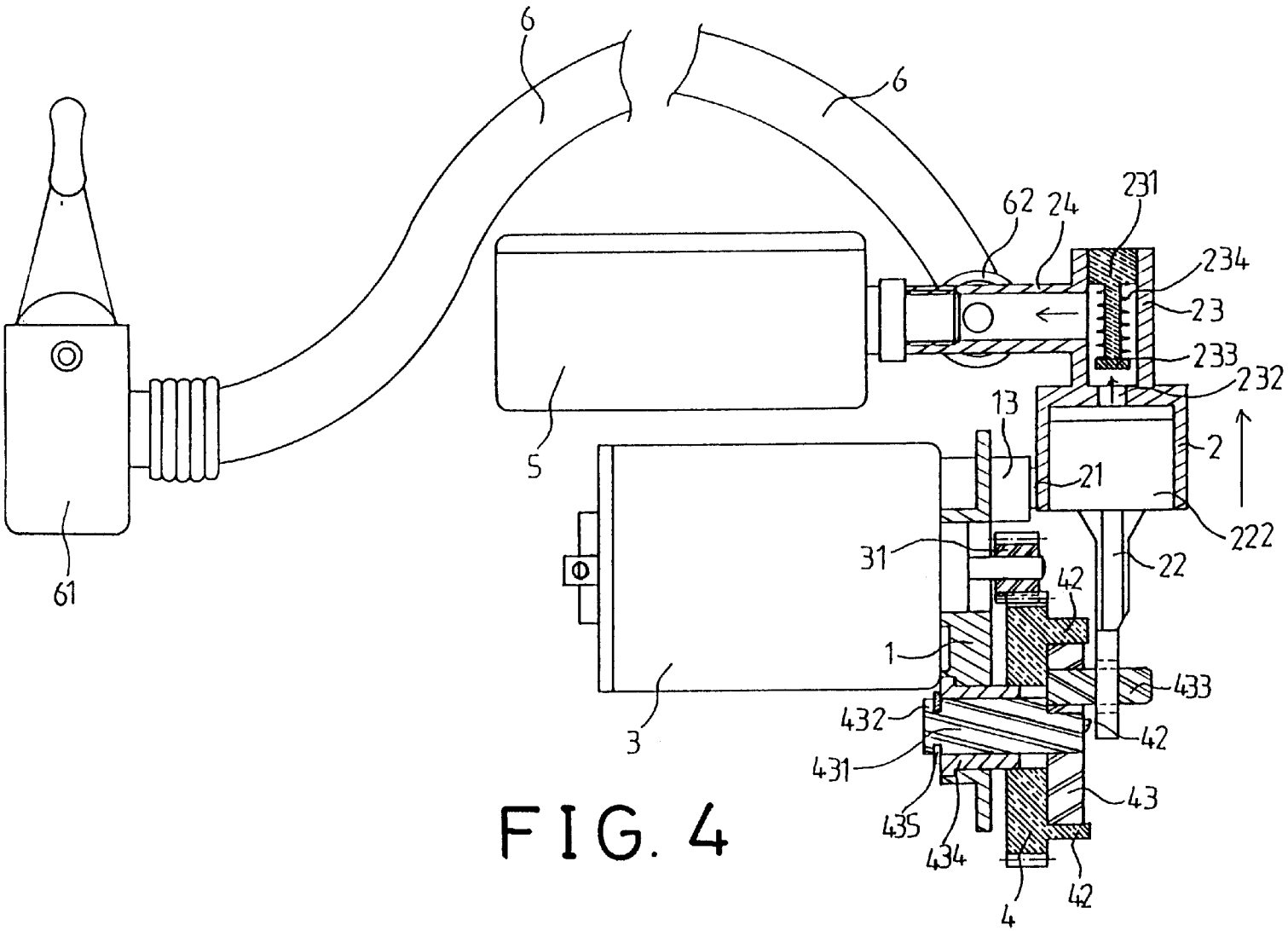
FIG. 4 is a partial cross sectional view similar to FIG. 3, illustrating the operation of the air compressor.

As shown in FIGS. 3 and 4, the tube 23 includes a control valve, such as a check valve received therein for controlling the pressurized air to flow from the housing 2 to the coupler 62 only and for preventing the pressurized air to flow back into the housing 2. The check valve includes a valve member 233 slidably received in the tube 23, a spring 234 engaged with the valve member 233 for biasing the valve member 233 to block the passage 232 of the housing 2. A cap 231 is secured on top of the tube 23 for retaining the spring 234 and the valve member 233 within the tube 23.

It is to be noted that the motor 3 and the gear 4 and the weight 43 may be attached onto the base 1 before the base 1 is secured to the housing 2. The base 1 may be easily and quickly secured to the housing 2 with the fasteners 7 after the pin 433 of the weight 43 is engaged through the orifice 221 of the rod 22, such that the air compressor includes a greatly simplified configuration that may be easily manufactured and assembled.

In operation, as shown in FIGS. 3 and 4, the piston 222 may be moved up and down along the chamber 20 of the housing 2 in a reciprocating action by the motor 3 via the eccentric pin 433 of the weight 43. The air received in the chamber 20 of the housing 2 may be forced through the passage 232 of the housing 2 (FIG. 4) and may force the valve member 233 against the spring 234 such that the air may be forced into the tube 23 and may be forced to the nozzle 61 when the piston 222 is moved toward the tube 23. The air may thus be pressurized by the piston 222 to generate the pressurized air when the piston 222 is moved in the reciprocating action in the housing 2.

Accordingly, the air compressor in accordance with the present invention includes a simplified piston for allowing the piston to be easily manufactured and assembled.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air compressor comprising:

a) a housing including a tube extended upward therefrom, and including a passage formed therein and communicating said housing with said tube. said housing including a chamber formed therein. said tube including a pipe extended outward therefrom. said housing including at least one extension extended therefrom, b) a pressure gage connected to said pipe, c) a nozzle connected to said pipe, d) a check valve received in said tube for controlling an air flow passage from said housing to said pipe, said check valve including a valve member slidably received in said tube, and means for biasing said valve member to block said passage of said housing and to prevent air from flowing from said tube to said housing, e) a piston slidably received in said chamber of said housing, said piston including a rod extended downward therefrom, f) a base including at least one sleeve provided thereon for receiving said at least one extension of said housing, g) means for securing said base to said housing, and h) means for forcing said piston to move along said chamber of said housing in a reciprocating action, said forcing means including:

i) a motor secured to said base and having a pinion provided thereon, ii) a weight including a pivot shaft extended outward therefrom and rotatably secured to said casing at said pivot shaft, said weight including a pin extended therefrom and eccentric relative to said pivot shaft, said pin being rotatably coupled to said rod, said weight including at least one shoulder formed therein, iii) a gear rotatably secured to said base at said pivot shaft and engaged with said pinion and driven by said motor via said pinion, said gear including at least one ear extended therefrom and engaged with said at least one shoulder of said weight for connecting said gear to said weight thus said weight and said gear are rotated in concert with each other, said motor and said gear and said weight are attached onto said base before said base is secured to said housing.

* * * * *